US005715764A

United States Patent [19]

Lyngfelt et al.

[11] Patent Number: 5,715,764

[45] Date of Patent: Feb. 10, 1998

[54] COMBUSTION METHOD

[75] Inventors: Anders Lyngfelt, Göteborg; Lars-Erik Åmand, Angered; Bo Leckner, Göteborg, all of Sweden

[73] Assignee: Kvaener EnviroPower AB, Sweden

[21] Appl. No.: 793,057

[22] PCT Filed: Aug. 8, 1995

[86] PCT No.: PCT/SE95/00941

§ 371 Date: Feb. 13, 1997

§ 102(e) Date: Feb. 13, 1997

[87] PCT Pub. No.: WO96/06303

PCT Pub. Date: Feb. 29, 1996

[30] Foreign Application Priority Data

Aug. 19, 1994 [SE] Sweden ..... 9402789

[51] Int. Cl.[6] ..... F22B 1/02

[52] U.S. Cl. ..... 110/245; 110/214; 110/345

[58] Field of Search ..... 110/245, 214, 110/204, 345, 347

[56] References Cited

U.S. PATENT DOCUMENTS

| | | | |
|---|---|---|---|
| 4,616,576 | 10/1986 | Engstrom et al. | 110/345 |
| 5,103,773 | 4/1992 | Andersson et al. | 122/4 D |
| 5,131,335 | 7/1992 | Spliethoff et al. | 110/345 |
| 5,159,886 | 11/1992 | Schaub et al. | 110/347 |
| 5,190,451 | 3/1993 | Goldbach | 431/5 |
| 5,237,963 | 8/1993 | Garcia-Mallol | 122/4 D |
| 5,325,796 | 7/1994 | Garcia-Mallol | 110/245 |
| 5,341,766 | 8/1994 | Hyppanen | 122/4 D |
| 5,526,775 | 6/1996 | Hyppanen | 122/235.11 |

*Primary Examiner*—Ira S. Lazarus
*Assistant Examiner*—Nhat-Hang H. Lam
*Attorney, Agent, or Firm*—Fasth Law Firm; Rolf Fasth, Esq.

[57] ABSTRACT

When burning solid fuels in a combustor, which operates with a circulating fluidized bed, substantially oxidizing conditions are maintained in the lower parts of the combustion chamber and approximately stoichiometric conditions in the upper parts of the combustion chamber, and afterburning of the flue gases separated from the bed particles is carried out.

15 Claims, 3 Drawing Sheets

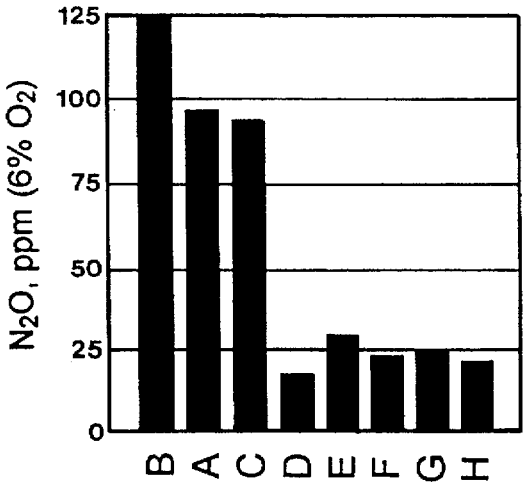
FIG. 3 - $N_2O$ - EMISSION
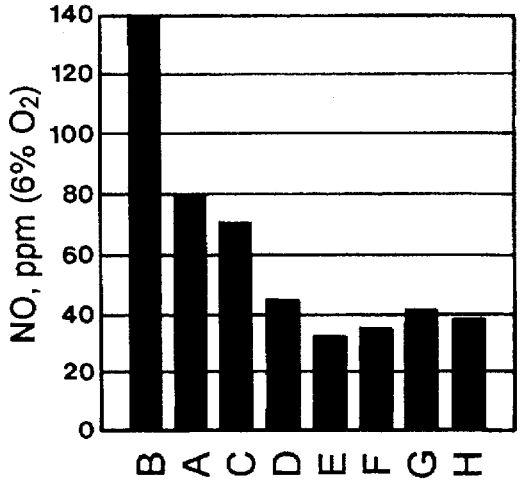
FIG. 4 - NO - EMISSION
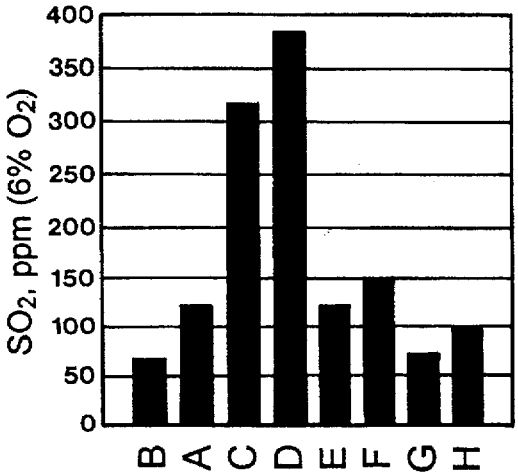
FIG. 5 - $SO_2$ - EMISSION
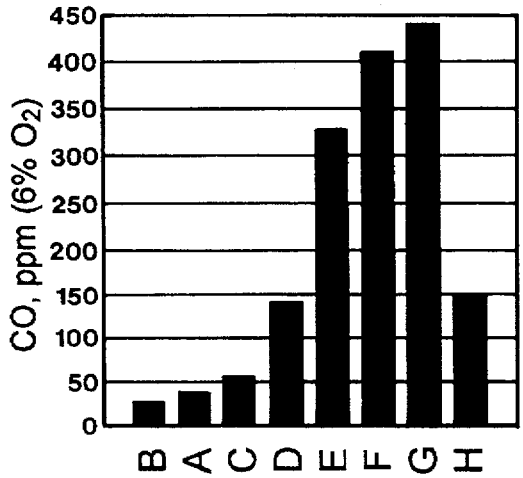
FIG. 6 - CO - EMISSION

COMBUSTION METHOD

BACKGROUND AND SUMMARY OF THE INVENTION

The present invention relates to a combustion method, and more specifically a method for combustion of solid fuels in a fluidised bed combustor (FB combustor).

There are two reasons for the rapid increase of fluidised bed combustion (FBC) in combustors. First, many different types of fuels, which are difficult to burn in other combustors, can be processed in FB combustors. Precisely the liberty of choice in respect of fuels in general, not only the possibility of using fuels which are difficult to burn, is an important advantage of fluidised bed combustion. The second reason, which has become increasingly important, is the possibility of achieving, during combustion, a low emission of nitric oxides and the possibility of removing sulphur in a simple manner by using limestone as bed material.

It is well known that in combustion of coal and other sulphurous solid fuels in FB combustors it is possible to affect the contents in the flue gases of noxious emissions of NOx (i.e. both NO and $NO_2$) and sulphur oxides ($SO_2$ and $SO_3$).

Since a number of years ago it has also been found that nitrous oxide (laughing gas) promotes the greenhouse effect as well as the reduction of the ozone layer in the stratosphere, extensive research into precisely this type of emissions has been carried out in recent years. Several investigations [see, inter alia, L. E. Åmand and S. Andersson "Emissions of nitrous oxide ($N_2O$) emissions from fluidized bed boilers", 10th International Conference on Fluidized Bed Combustion (ed. Manaker), ASME, San Fransisco, 1989; Mjörnell et al "Emissions control with additives in CFB coal combustion", 11th International Conference on Fluidized Bed Combustion, ASME, Montreal, 1991; Åmand et al "$N_2O$ from circulating fluidized bed boilers—present status", LNETI/EPA/IFP European Workshop on $N_2O$ Emissions, Lisbon 1990; and EPA Workshop on $N_2O$ emissions from combustion (eds Lanier and Robinson), EPA-600/86-035, 1986] have demonstrated $N_2O$ emissions from fluidised bed combustion in the order of 20–150 mg $MJ^{-1}$ (40–250 ppm at 6% $O_2$). Bo Leckner and Lennart Gustavsson have shown in an article entitled "Reduction of $N_2O$ by gas injection in CFB boilers" in Journal of the Institute of Energy, September 1991, 64, 176–182, that it is possible to reduce the emissions of nitrous oxide during combustion in a circulating fluidised bed (CFB combustion) by effecting in the cyclone, after separation of the circulating bed particles, afterburning in the cyclone by means of a gas burner mounted therein for combustion of a separately supplied combustible gas, usually methane. In the experiments carried out it was found that considerable reductions of the emissions of nitrous oxide could be achieved without significant increases of the NO emissions, at the same time as a reduction of the CO emissions could be achieved when combustible gas was supplied for this afterburning.

A further example of a similar technique for reducing the emissions of nitrous oxide is described in the published European Patent Application EP-A-0,569,183, according to which afterburning of the flue gases is also carried out after the cyclone, which is used for separating the bed particles in a CFB combustor (i.e. a combustor operating with a circulating fluidised bed). In the method according to this publication, the combustor operates under reducing conditions in the fluidised bed, thus leaving a sufficient amount of combustible material in the flue gases, such that it should be possible to achieve the desired afterburning when oxygen-containing gases are added to the separated flue gases. Secondary air is supplied to the combustion chamber above the fluidised bed, but substoichiometric conditions are still maintained in the entire combustion chamber. An NOx-cleaning agent is added to the separated flue gases, which are then used for superheating of generated vapour in a subsequent superheater.

The published European Patent Application EP-A-0,571,234 discloses a two-stage combustion process in an FB combustor, in which the lower regions of the bed are operated under substoichiometric conditions and the upper regions of the bed are operated under hyperstoichiometric conditions. The temperature is controlled in the upper regions of the bed so that the emissions of $N_2O$, NOx and SOx may be simultaneously lowered. This temperature control is carried out by controlling the amount of bed particles in the upper regions of the bed, this control being carried out by controlling the velocity of the supplied fluidising gases and by recirculating bed particles from the upper regions of the bed to the lower regions thereof. No afterburning of combustible residues in the flue gases is carried out after separating the bed particles from the flue gases.

Also the published European Patent Application EP-A-0,550,905 is drawn to the technique of reducing the emissions of nitrous oxide during combustion in a fluidised bed combustor. In this case, the fuel is burnt at 700°–1000° C., and calcium material is added to reduce the SO and SOx emissions. The bed particles are separated from the flue gases, and these are then treated in a subsequent reactor for reducing the content of nitrous oxide. This subsequent reactor may include a second fluidised bed in which at least part of the flue gases from the main combustion is used to fluidise the bed particles in this second fluidised bed, in which case the main fluidised bed or the first fluidised bed is operated in such a manner that the flue gases leave this, having an excess of oxygen.

PCT Publication WO93/18341 also discloses a two-stage combustion process for reducing the emissions of noxious substances from a fluidised bed combustor. In this case, partial combustion and gasification of the fuel particles is carried out in a bubbling bed under substoichiometric (reducing) conditions, and the remaining solid fuels and gasified combustible substances are finally burnt in a second combustion zone above the bubbling bed, hyperstoichiometric (oxidising) conditions being maintained in this second combustion zone. The bed particles are separated from the flue gases only after the complete combustion, and no aftertreatment of the flue gases is carried out after this separation.

In subsequent investigations [Bo Leckner, "Optimization of Emissions from Fluidized Bed Boilers", International Journal of Energy Research, Vol. 16, 351–363 (1992)] it has, however, been found to be a great problem that unfortunately measures for reducing the $N_2O$ emissions also increase the $SO_2$ and NO emissions. These investigations resulted in the statement that basically two possible parameters, viz. excess air and bed temperature, can be used to reduce the emissions of nitrous oxide. It has also been established that a considerable decrease of the $N_2O$ and NO emissions can be achieved by improving the fuel feed system and the control system for allowing a lower excess air ratio, at least 20% excess air being used. It is also stated that it is considerably more important to increase the bed temperature from the conventional temperature 830°–850° C. to the temperature 900° C. in order to compensate for the higher NO emission by ammonia injection and compensate for the less efficient sulphur capture by an increased limestone addition. A further decrease of the $N_2O$ emissions is also suggested by arranging in the flue gas duct a burner for increasing the gas temperature by additional combustion.

A similar method for reducing the $N_2O$ emissions by gas injection in CFB boilers has been suggested by Lennart Gustavsson and Bo Leckner in the article "$N_2O$ Reduction with Gas Injection in Circulating Fluidized Bed Boilers", 11th International Conference on Fluidized Bed Combustion, Montreal, 1991. This article states among other things that air can be injected after the cyclone and that this measure may lead to reduced CO emissions.

Bo Leckner and Lars-Erik Åmand also state in the article "$N_2O$ Emissions from Combustion in Circulating Fluidized Bed" at the 5th International Workshop on Nitrous Oxide Emissions NIRE/IFP/EPA/SCEJ, Tsukuba, July 1992, that the $N_2O$ emissions from fluidised bed combustion can be reduced or eliminated by using a low excess air ratio, a suitable arrangement for the air supply and a high bed temperature, but that such measures would imply a new optimisation of fluidised bed combustion processes and a consideration of the influence of the parameter changes on combustion efficiency, temporary emissions of volatile organic compounds and the consumption of limestone. Similar statements have been made by the same and other authors in other articles concerning nitrous oxide emissions in fluidised bed combustion [cf. L-E Åmand and Bo Leckner, "Influence of Air Supply on the Emissions of NO and $N_2O$ from a Circulating Fluidized Bed Boiler", 24th Symposium (International) on Combustion/The Combustion Institute, 1992, 1407–1414; L-E Åmand and Bo Leckner, "Influence of Fuel on the Emission of Nitrogen Oxides (NO and $N_2O$) from an 8-MW Fluidized Bed Boiler", Combustion and Flame 84: 181–196 (1991); L-E Åmand and Bo Leckner, "Oxidation of Volatile Nitrogen Compounds during Combustion in Circulating Fluidized Bed Boilers", Energy & Fuels, 1991, pp. 809–815; L-E Åmand, Bo Leckner and S. Andersson "Formation of $N_2O$ in Circulating Fluidized Bed Boilers", Energy & Fuels, 1991, pp. 815–823].

Regarding the problem of capturing sulphur and reducing the $SO_2$ emissions, Anders Lyngfelt and Bo Leckner have stated in the article "$SO_2$-Capture in Fluidized-Bed Boilers: Re-Emission of $SO_2$ due to Reduction of $CaSO_4$", Chemical Engineering Science, Vol. 44, No. 2, pp. 207–213 (1989), that there is a conflict between on the one hand achieving low NOx emissions and, on the other hand, achieving low $SO_2$ emissions in fluidised bed boilers. In the article "Model of Sulphur Capture in Fluidised-Bed Boilers under Conditions Changing between Oxidising and Reducing", Chemical Engineering Science, Vol. 48, No. 6, pp. 1131–1141 (1993), the same authors state that this problem involves a competition between sulphur capture and sulphur release and that this reaction can be temperature-dependent. To describe the desulphurisation under these conditions, a model is suggested, in which alternatingly oxidising and reducing conditions are used. The results presented show that reducing conditions yield a lower utilisation of the sorbent in increased sulphur capture and at increased temperature, and that reducing conditions have a negative effect at all temperatures that are used in fluidised bed combustion, also at temperatures below 850° C. The temperature dependence of the different reactions has also been confirmed in other articles [Anders Lyngfelt and Bo Leckner, "Sulphur capture in fluidised-bed combustors: temperature dependence and lime conversion", Journal of the Institute of Energy, March 1989, pp. 62–72; Lars-Erik Åmand, Bo Leckner and Kim Dam-Johansen, "Influence of $SO_2$ on the $NO/N_2O$ chemistry in fluidized bed combustion", Fuel 1993, Vol. 72, No. 4, pp. 557–564; Anders Lyngfelt and Bo Leckner, "$SO_2$ capture and $N_2O$ reduction in a circulating fluidized-bed boiler: influence of temperature and air staging", Fuel 1993, Vol. 72, No. 11, pp. 1553–1561; and Anders Lyngfelt, Klas Bergqvist, Filip Johnsson, Lars-Erik Åmand and Bo Leckner, "Dependence of Sulphur Capture Performance on Air Staging in a 12 MW Circulating Fluidised Bed Boiler", 2nd International Symposium on Gas Cleaning at High Temperatures, September 1993, published in Gas Cleaning at High Temperatures, Eds. R. Clift & J. P. K. Seville, Glasgow, 1993, pp. 470–491].

As mentioned above and as shown by many of the publications referred to, measures for reducing the $N_2O$ emissions unfortunately result in an increase of the $SO_2$ and NO emissions. This has also been confirmed in the using of a new combustion system having a plurality of circulating fluidised beds (MCFB, multi-circulating fluidised bed), in contrast to older systems with bubbling beds and single circulating beds, as reported by U. N. Johansen, T. Lauridsen and F Ørssleff in the article "Cogeneration systems: Advanced fluidized bed set for cogeneration", Modern Power Systems, January 1992, pp. 39–40.

It thus is well known that for a reduction of one type of emissions, one must give up the reduction of one or more other types of emissions. Therefore, there is a need to optimise the combustion in a fluidised bed combustor in such a manner that all emissions will be as low as possible. One object of the present invention therefore is to provide a new method for operating a fluidised bed combustor in order to achieve this optimisation.

The invention is based on the knowledge on the one hand that combustion of coal or other sulphurous fuels in fluidised bed combustors with a circulating fluidised bed is a technique which makes it possible to obtain, in a simple manner, low emissions of nitric oxides, NOx (i.e. NO and $NO_2$) as well as sulphur dioxide $SO_2$ (also $SO_3$) and, on the other hand, that such combustors also emit relatively large amounts of nitric oxide which is considered to have a negative effect on the ozone layer and is a greenhouse gas, which in the long run affects the climate of the earth. The invention is further based on the knowledge that the two most important parameters for emissions from a combustor are the air supply and the temperature and that other important parameters are the amount of added sorbent for desulphurisation (usually limestone) and the recirculation of solid matter.

The same basic knowledge has been used in the above-mentioned published European Patent Application EP-A-0, 569,183 and the above-mentioned article "Reduction of $N_2O$ by gas injection in CFB boilers" (Bo Leckner and Lennart Gustavsson, Journal of the Institute of Energy, September 1991, 64, 176–182). However, in these cases, the conclusion has been made that in combustion in a circulating fluidised bed (CFB combustion) afterburning in the cyclone should be carried out after separation of the circulating bed particles. In the last-mentioned case afterburning is provided by additional burning of a separately added combustible gas in the flue gases after the cyclone, and in the first-mentioned case afterburning is provided by carrying out the combustion in the combustion chamber of the combustor in such a manner that combustible material remains in the flue gases after leaving the cyclone. According to EP-A-0,569,183, use is made of step-by-step supply of the combustion air to the combustion chamber of the combustor, such that reducing conditions are maintained in the entire combustion chamber. By the supply of air occurring step-by-step in the stated manner, reducing conditions (oxygen deficiency) occur locally in the bed, such that the concentration of combustible gases (CO, hydrocarbons, $H_2$) is high and the oxygen concentration so low that it is not sufficient for combustion of the combustible gases. For combustion of these gases, secondary air is supplied above the bed, but also this supply of secondary air is insufficient for complete combustion of the remaining combustible material, since this is to be used in the afterburning of the flue gases after separation of the bed particles. According to the last-mentioned article, secondary air is also supplied above the bed, but afterburning is provided by additional burning of separately supplied combustible gases after separation of the bed particles in the cyclone.

According to the invention, the problem of reducing the $N_2O$ emission without simultaneously increasing emissions of NOx and $SO_2$ has been solved in a different manner. The effect of the two main parameters, i.e. the air supplying technique and the bed temperature, at a constant excess air ratio, can be summarised as follows. An increased air supply division into different stages (primary, secondary and optionally also tertiary air supply) promotes a low NO emission and, to some extent, also a low $N_2O$ emission, but yields high $SO_2$ emissions, whereas the opposite promotes sulphur capture but results in high NO emissions. On the other hand, an increased temperature will yield low $N_2O$ emissions but high NO and $SO_2$ emissions. To the expert, this indicates that it would not be possible to obtain simultaneously low emissions of all three types of pollutants, without taking costly measures for treating the flue gases leaving the combustor.

The combustion in a combustor operating with a circulating fluidised bed is highly complex, and it has now been discovered that the processes or reactions causing one emission to increase and another to decrease are connected to each other merely indirectly. The invention has indicated a possibility of circumventing the apparent interconnection of the three types of pollutants by a more selective use of measures which affect the contents of pollutants. In experiments, which will be described below, it has been found that by using bituminous coal having an average sulphur content for heating, one could reduce the emission of $N_2O$ to one quarter (25 ppm), the emission of NO to half (about 50 ppm) without significantly affecting the sulphur removal (90%), as compared with prior art technique at a normal operating temperature and with a normal supply of air conducted step-by-step.

To sum up, the inventive method can be described in such a manner that substantially oxidising conditions are maintained in the lower part of the combustion chamber and that approximately stoichiometric conditions are maintained in the upper part of the combustion chamber, and that the flue gases after separation of the bed particles are subjected to afterburning. The invention thus differs from prior art technique, in which reducing conditions have been maintained in and above the bed.

According to EP-A-0,569,183, use is made of reducing conditions in the lower regions of the bed and also above the bed, and combustion takes place in the combustion chamber under substoichiometric (reducing) conditions to effect the pyrolysis of combustible material while minimising the production of NOx compounds. This publication does not mention the possibilities of obtaining satisfactory desulphurisation, nor the effects of the combustion method on the $N_2O$ emission.

According to the present invention, use is made of a very special mode of operation which is a balancing between the effects of the degree of oxidising/reducing conditions on the various types of emissions, the invention using the unexpected discovery that oxidising/reducing conditions affect the different types of emissions in different ways within different regions of the combustion plant (cyclone and top and bottom regions of the combustor). The experiments with the invention, which are described below, show that a deviation from this specific mode of operation yields a deterioration of the result in respect of desulphurisation and combustion efficiency or in respect of the emissions of laughing gas and NO.

In the invention, use is thus made of conditions which are different from those in prior art technique, according to which reducing conditions are present in the bottom zone and oxidising or reducing conditions are present in the upper zone. Compared to conventional technique, apart from the technique according to EP-A-0,569,183, there are in the inventive method substantially lower contents of oxygen in the upper part of the combustion chamber and the cyclone, while a considerably larger amount of air is supplied to the bottom zone. It seems to be precisely the combination of these two changes that has made it possible to obtain very low emissions of laughing gas and, at the same time, reduced NO emissions and unchanged satisfactory desulphurisation. If, in the invention, an approximately stoichiometric amount of air is supplied to the bottom of the combustion chamber, this implies in reality an oxygen excess in the gas phase within the bottom zone, i.e. hyperstoichiometric conditions, since part of the oxygen supplied is consumed high up in the combustion chamber and in the cyclone (or some other particle separator) in the combustion of solid fuels. Since it has been found that an excess of oxygen in the gas phase within the bed has a favourable effect on the desulphurisation, this is a great advantage of the invention. A further great advantage of the invention is that the low air ratio within the upper part of the combustion chamber and in the cyclone yields very low emissions of $N_2O$ and also low emissions of NOx.

The invention is particularly useful and advantageous in the combustion of low and medium volatile fuels, but is also useful in the combustion of high volatile fuels. A lower air ratio can be used in high volatile fuels as compared to low and medium volatile fuels while maintaining stoichiometric or hyperstoichiometric conditions in the lower parts of the bed.

In this description, the expression low and medium volatile fuels has been used for fuels whose amount of volatile matters is 1–63%, based on dry and ashless substance. The definition of such fuels varies somewhat between Sweden, the USA and Germany. According to Swedish practice, this definition comprises metaanthracite, anthracite, semianthracite, low volatile bituminous coal, medium volatile bituminous coal, high volatile bituminous coal, subbituminous coal, lignite and lignitic coal and petroleum coke which is a residual product from oil refining. According to US practice, however, lignitic coal and petroleum coke are not included, whereas according to German practice, metaanthracite, anthracite, lean coals, fat coals, gas coal, open burning coal, black lignite, dull coal and brown coal are included.

In this description, the expression high volatile fuels is used for fuels having a volatile content of 63–92%, based on dry and ashless substance. Examples of such fuels are wood chips, peat, chicken manure, sludge from sewage-treatment plants, the fuel fraction from waste sorting plants (so-called RDF) and used car tires which have been prepared for burning by the removing of steel cord and by cutting into suitable particle fractions for burning in fluidised bed combustors. The RDF fraction may also include the nitrogen-rich organic fraction, which however is normally composted.

As mentioned above, the invention relates to a new method for reducing the $N_2O$ emissions without increasing the emissions of the other pollutants, NOx and $SO_2$. In prior art technique, use is often made of step-by-step supply of the combustion air to CFB combustors, which means that only part of the combustion air, the primary air, is supplied to the bottom part of the combustion chamber, in which the lower and tighter parts of the fluidised bed are located. This method of supplying air means that the oxygen concentration in the gas phase in the lower part of the combustion chamber is low, whereas the supply of secondary air higher up in the combustion chamber causes more oxidising conditions in the gas phase in the upper part of the combustor and in the cyclone or particle separator. The invention is based on the discovery that by changing the air supply, it is possible to reverse the conditions in the upper and lower parts of the combustion chamber in respect of $O_2$ and, consequently, achieve great advantages in the form of reduced emissions of all the pollutants involved. In the invention, the conditions in the upper and lower parts of the combustion chamber are thus to be reversed in relation to the conventional technique, i.e. the oxygen concentration in the gas phase is to be reduced in the upper part and increased in the lower part of the combustion chamber. This is achieved in the preferred embodiment by supplying air to the lower part of the combustion chamber in an amount corresponding to an air ratio of about 1 (with certain variations depending on the type of fuel etc.). This also includes air which in the bottom part is optionally supplied from the sides of the combustion chamber, so-called highly primary air, and the air which for practical reasons must be supplied via, for instance, fuel feed chutes, particle coolers and air separators. The air required for final combustion is added after the particle separator. Secondary air is supplied either not at all (which is preferred) or by a portion amounting to 15% at most, preferably 10% at most and most preferred 5% at most of the air which as mentioned above is to be added to the lower parts of the combustion chamber being supplied on a higher level in the combustion chamber, however while maintaining substantially oxidising conditions in the gas phase in the lower parts of the combustion chamber.

In the following description of the invention, the following nomenclature is used:

$K_c$ the ratio of theoretical flue gas (including moisture) to theoretical air (–), $O_2$ oxygen concentration in the flue gases, including moisture (02,o in Table 4) (%), O2,c oxygen concentration in the gas from the cyclone (equation 5) (%), $\lambda_{tot}$ total air ratio (–)

$\lambda_c$ air ratio of the combustion chamber (equation 6) (–)

The problem lying in the background of the invention is that laughing gas, $N_2O$, is a greenhouse gas and is assumed to reduce the ozone layer in the stratosphere and that this discovery all at once changed the attitude to the fluidised bed technique as combustion method. From having previously been considered a "pure" burning method (low emissions of $NO_2$ and $SO_2$,), it has been reclassified as a "dirty" method ($N_2O$ remains non-degraded).

As shown by the above-mentioned publications, the procedures involved in the production and degradation of NO and $N_2O$ are complex and not quite scientifically analysed. This also applies to the removal of sulphur pollutants in burning by using a reaction with CaO into $CaSO_4$ and a reductive degradation of $CaSO_4$.

It also appears from the references to literature used that the emissions of NOx, $SO_2$ and $N_2O$ can be reduced or increased to a considerable extent by changing the operational parameters, for instance bed temperature and air supply. As mentioned above, the problem is that a successful measure for reducing one of the types of emission has an opposite effect on one of or both of the other types of emission. An increased bed temperature thus results in a reduction of the $N_2O$ emission, but at the same time the NO emission increases and a great reduction of the sulphur capture efficiency occurs. An increased degree of step-by-step supply of the combustion air results on the other hand in a reduction of the NO emissions and a certain reduction of the $N_2O$ emissions, but at the same time the sulphur capture falls to a very great extent.

By step-by-step supply of the combustion air is meant that part of the combustion air is supplied in the form of secondary air at a later stage of the combustion process. The degree of step-by-step supply can be increased by lowering the primary air ratio (=the total air ratio×the amount of primary air) or by increasing the level of the secondary air supply in the combustor or by taking both measures. These measures increase the occurrence of zones having reducing conditions, which is assumed to be the most important effect of step-by-step air supply in respect of emissions. Another measure which yields a similar effect is a reduction of the total air ratio.

A lowered primary air ratio means a reduced available amount of oxygen in the lower parts of the combustion chamber, which results in more reducing conditions, which affects the combustion and other chemical reactions. Moreover, the concentration of combustible particles in the system will increase, and part of the combustion will be moved upward from the bottom zone of the combustion chamber. The change of the gas velocity in the bottom zone will also affect the performance of the bed and the motions of the bed particles. The total effect of a reduction of the primary air ratio thus is changes in the entire combustion chamber, and the final effect on the complex balance reactions regarding NOx/$N_2O$ and $SO_2$ is not fully demonstrated. The final effect, however, is known, i.e. an increase of the occurrence of zones having reducing conditions results in the NO and $N_2O$ emissions decreasing and the $SO_2$ emission increasing.

The invention is based on the discovery that it is possible to provide a simultaneous reduction of the NO, $N_2O$ and $SO_2$ emissions by reversing the conditions prevailing in conventional technique for step-by-step air supply, such that substantially oxidising conditions are maintained in the gas phase in the lower parts of the combustion chamber and approximately stoichiometric conditions are maintained in the gas phase in the upper parts of the combustion chamber, and such that the remaining air is supplied to the flue gas outlet of the particle separator for providing final combustion in a space after this flue gas outlet.

By reducing conditions is meant according to the invention that a substoichiometric gas mixture is present, i.e. the amount of oxygen is not sufficient for burning off the combustible gases present. This state can be measured by means of a zirconium oxide probe which measures the equilibrium concentration of the oxygen. Under reducing conditions, the equilibrium concentration of the oxygen is below $10^{-6}$ bar, normally $10^{-10}$ to $10^{-15}$ bar. Reducing conditions may occur locally in the vicinity of burning particles and in the bottom zone when air is supplied step-by-step. These reducing conditions arise and are also reinforced by the presence of a high concentration of bed particles in the lower parts of the combustion chamber, since streakings and bubbles of supplied air can pass the bed particles, such that a uniform distribution of air over the cross-section of the bed is not achieved.

Investigations have shown that there are quick changes between oxidising and reducing conditions, and a change of the degree of step-by-step air supply affects the amount of the time during which each local position in the bed is under reducing conditions. A change from normal air supply with step-by-step supply of the air (i.e. primary air at the bottom and secondary air at the top of the combustion chamber) to air supply in which all the air is supplied to the bottom zone, i.e. in a change from an air ratio in the bottom part of about 0.7 to an air ratio of about 1.2, resulted in e.g. a reduction of the amount of time under local reducing conditions to about 1/8 on a level of 0.65 m from the bottom of the combustion chamber, when using the same boiler as in the experiments described below (cf. Anders Lyngfelt, Klas Bergqvist, Filip Johnsson, Lars-Erik Åmand and Bo Leckner, "Dependence of Sulphur Capture Performance on Air Staging in a 12 MW Circulating Fluidised Bed Boiler", 2nd International Symposium on Gas Cleaning at High Temperatures, September 1993, published in Gas Cleaning at High Temperatures, Eds. R. Clift & J. P. K. Seville, 1993, pp. 470–491).

The oxygen concentration in different parts of a CFB combustor and the space of time in which reducing conditions prevail in these parts will be discussed in more detail below.

In respect of sulphur capture, the sulphur emitted from the fuel will, in the presence of $O_2$, be oxidised to $SO_2$. The emission of $SO_2$ can be reduced by adding limestone which after calcination and in the presence of $O_2$ reacts with $SO_2$ $$SO_2+CaO+1/2O_2 \rightarrow CaSO_4 \quad (1)$$

Under reducing conditions, the reaction (1) can be reversed in the presence of reducing gases such as CO and $H_2$ $$CaSO_4+CO \rightarrow +CaO+SO_2+CO_2 \quad (2)$$

Alternatively, $CaSO_4$ can first be reduced to CaS (for instance, in the lower part of the combustion chamber), which may then be oxidised during release of $SO_2$ (for instance, in the upper part of the combustion chamber).

The release of $SO_2$ occurs only when sorbent particles are exposed to reducing conditions; the oxygen concentration as such is assumed not to affect the sulphur capture. Starting from the basic knowledge of the sulphur capture reactions, it is difficult to draw any reliable conclusions regarding the effect of reducing conditions on the sulphur capture mechanism in the different parts of the combustion chamber. However, experiments have clearly shown that an increased space of time under reducing conditions in the bottom zone (i.e. an increased degree of step-by-step supply of air) is disadvantageous to the sulphur capture. A reduction of the total air ratio is negative to the sulphur capture process, but whether this should be ascribed to changed conditions in the lower or upper parts of the combustion chamber is unclear for the time being.

The reactions applying to the $N_2O$ and NO production and decomposition have recently been examined and are reported in the literature [cf. M A Wójtowicz, J R Pels and J A Moulijn, "Combustion of coal as a source of $N_2O$ emission", Fuel Processing Technology 34, 1–71 (1993)]. Even if a number of homogenous and heterogeneous reaction mechanisms are known from laboratory measurements, additional studies are required to convert these results into practical work with CFB combustors. Certain empirically established facts, that have appeared in experiments, can, however, be used in the context.

The $N_2O$ concentration increases with the level in the combustion chamber. The production of $N_2O$ in the lower part is high, but this production makes but a small contribution to the $N_2O$ emission of the combustor, since a great reduction occurs along the path of motion of the gases through the combustion chamber. Consequently, the effect of a step-by-step air supply will be small as long as the changes of the air supply amounts do not concern the bottom zone of the combustion chamber. The result of air supply changes in the upper part of the combustion chamber is not fully analysed, but some references concern this matter [cf. L-E Åmand and Bo Leckner, "Influence of Air supply on the Emissions of NO and $N_2O$ from a Circulating Fluidized Bed Boiler", 24th Symposium (International) on Combustion/The Combustion Institute, 1992, 1407–1414]. First, it has been reported that the $N_2O$ emission decreases as the secondary air supply position is moved upward in the combustion chamber, and second, it has been reported that the $N_2O$ emission decreases to a considerable extent when half of the secondary air addition is supplied about halfway up in the combustion chamber and the remainder is supplied to the cyclone outlet, which resulted in a very low oxygen concentration in the entire combustor. These results as reported, however, had been achieved with a CFB combustor which was operated with sand as bed particles, and it is not known whether the results would be the same if a sorbent for sulphur capture was admixed to the bed. A further indication of the effect of conditions in the upper parts of the combustion chamber is the total air ratio. Supposing that the effect of this total air ratio is important, this should then be ascribed to the conditions in the upper part of the combustion chamber, since the conditions in the lower parts of the combustion chamber have but a moderate effect on the $N_2O$ emissions. Data presented in the literature concerning the effect of the total air ratio are, however, unreliable owing to the difficulties of keeping the temperature constant in the upper part of the combustion chamber. The above-mentioned article by Åmand and Leckner (1992) reports a significant effect of the air ratio on the $N_2O$ production at a constant temperature in the upper part of the combustion chamber, but also in this case no sorbent for sulphur capture was present in the experimental combustions.

In respect of the NO emission, the situation is different, and the NO concentration decreases with the level in the combustion chamber. The effect of step-by-step supply of air to the combustion chamber is considerable, particularly in the bottom zone. Changes of the total air ratio have a significant effect on the NO emission, but to what extent this can be ascribed to the changes in the bottom zone or the changes in higher zones has not been established in view of the demonstrated great effect of the air addition in the bottom zone. In the above-mentioned article by Åmand and Leckner (1992) it is, however, stated that the NO emission is not strongly affected by moving the secondary air supply position to a higher level in the combustion chamber.

Summing up, it can be established that the effect of reducing conditions in the lower parts of the combustion chamber is important to the NO and $SO_2$ emissions, but small or moderate to the $N_2O$ emission. Data available in the literature indicate that the effect of changes in the upper parts of the combustion chamber could be important to the $N_2O$ emission, but the situation is elucidated to a lower degree regarding the effects on the $SO_2$ and NO emissions.

It is obvious that the sulphur capture is affected by the amount of the time during which reducing conditions prevail, but the emissions of $N_2O$ and NO can also be affected by the oxygen concentration as such.

According to the invention, it has however been disclosed that by special control of the air supply to a CFB combustor, reduced emissions of NOx, $N_2O$ and $SO_2$ can be achieved at the same time.

The invention will now be described in more detail with reference to the accompanying drawings which concern the now preferred best embodiment of the invention.

DESCRIPTION OF THE DRAWINGS

FIG. 3 is a diagram of the $N_2O$ emissions in experiments in which the invention has been compared with other combustion methods.

FIG. 4 is a diagram of the NO emissions in experiments in which the invention has been compared with other combustion methods.

FIG. 5 is a diagram of the $SO_2$ emissions in experiments in which the invention has been compared with other combustion methods.

FIG. 6 is a diagram of the CO emissions in experiments in which the invention has been compared with other combustion methods.

DESCRIPTION OF THE PREFERRED EMBODIMENT

Figure 1:
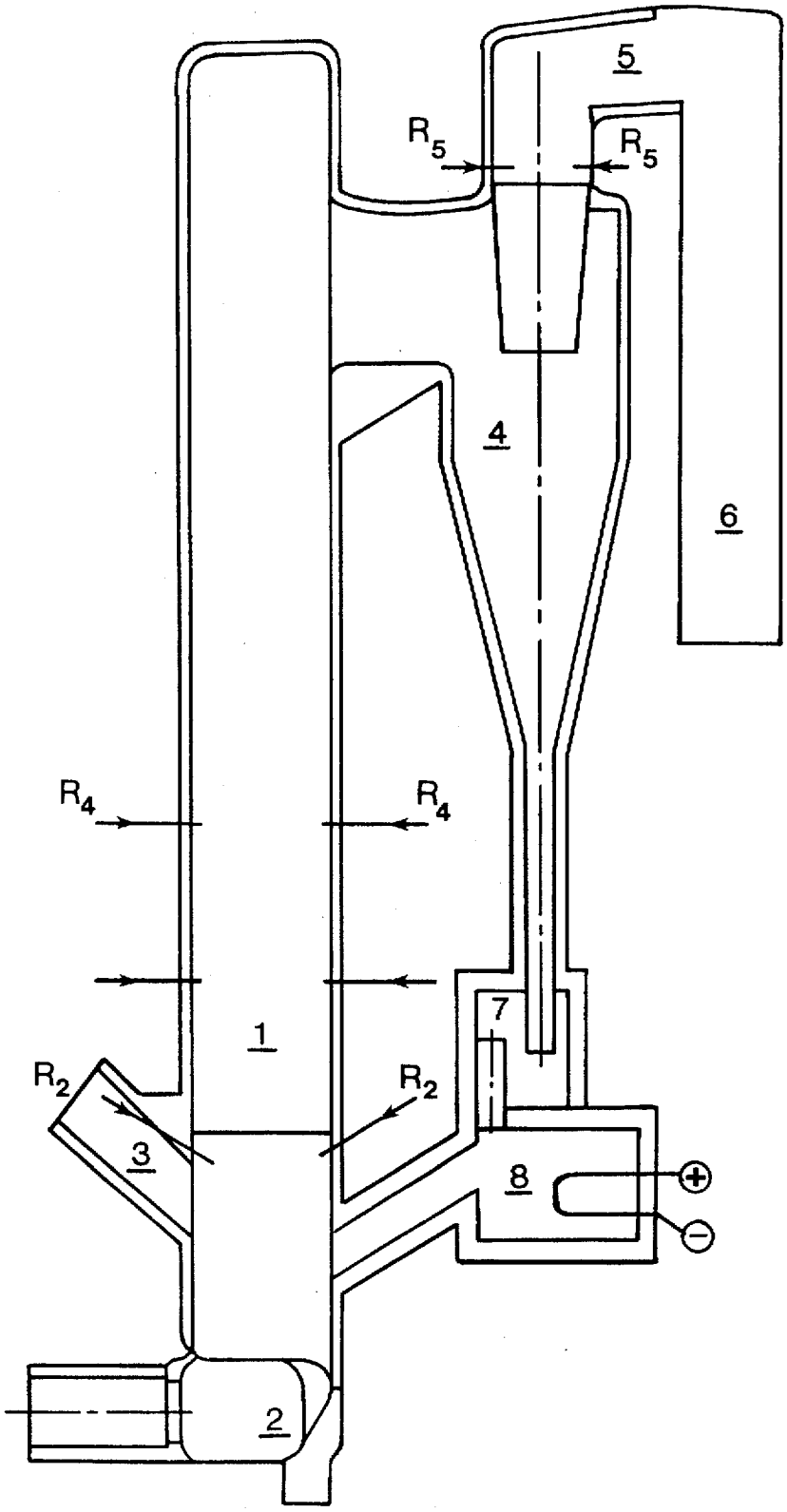
FIG. 1 illustrates the schematic design of a 12 MW combustor which was used in the experiments described below.

FIG. 1 illustrates a 12 MW combustor comprising a combustion chamber 1, an air supply and start-up combustion chamber 2, a fuel feed chute 3, a cyclone 4, a flue gas exit duct 5, a subsequent convection surface 6, a particle seal 7, a particle cooler 8, secondary air inlets R2 on a level of 2.2 m, R4 on a level of 5.5 m and R5 in the outlet of the cyclone 4. The combustor used was equipped for experiments but had all the features of the corresponding commercial combustors. The combustor was fitted for special measurements and comprised equipment for individual control of different parameters independently of each other and in a wider range than for a commercial combustor of the corresponding type, which implied that the combustor can be operated under extreme conditions which would be unsuitable for commercial combustors.

The combustion room of the combustor was of a height of 13.5 m and a square cross-section having an area of about 2.9 $m^2$. Fuel was supplied at the bottom of the combustion chamber 1 through the fuel feed chute 3. Primary air was supplied through nozzles which were arranged in the bottom of the combustion chamber and to which air was supplied from the air supply chamber 2. Secondary air could be supplied through several air registers which were arranged horizontally on both sides of the combustion chamber, as indicated by arrows in FIG. 1. Entrained bed material was separated in the cyclone 4 lined with refractory material and was recirculated to the combustion chamber through a return duct and the particle seal 7. Combustion air could also be added at R5 to the cyclone outlet. After the cyclone, the flue gases passed through the non-cooled flue gas exit duct 5 to be passed to subsequent convection and superheater surfaces, of which only a first convection surface 6 is shown.

FIG. 1 does not show a flue gas recirculating system which can be used to return flue gases to the combustion chamber 1 for fine adjustment of the combustor temperature. The external, regulatable particle cooler 8 of the experimental combustor had such a capacity that great intentional changes of the temperature could be carried out.

As sulphur sorbent use was made of limestone (from Ignaberga, Sweden), and as fuel use was made of bituminous coal having an average sulphur content. Data of limestone and fuel are shown in Table 1.

TABLE 1

| | |
|---|---|
| Fuel | Bituminous coal |
| Particle size, mm | <20 mm, 50% <10 mm |
| Moisture content, % by weight | 16 |
| Ash content, % by weight | 8 |
| Volatile content, % by weight* | 40 |
| Carbon content, % by weight* | 78 |
| Hydrogen content, % by weight* | 5.5 |
| Nitrogen content, % by weight* | 13 (estimated) |
| Sulphur content, % by weight* | 1.4 |
| Sorbent | Ignaberga limestone |
| Particle size, mm | 0.2–2 |
| $CaCO_3$ content, % by weight | 90 |

*based on dry and ashless substance

Measurements were carried out by means of regularly calibrated gas analysers (see Table 2) for continuous monitoring of $O_2$, CO, $SO_2$, NO and $N_2O$ in cold, dry gases. Apart from the analytical equipment (designated $O_{2,o}$ in Tables 2 and 4) which was used to determine the $O_2$ content by taking samples in the convection part of the combustor, all the analytical apparatus were connected to the flue gas duct after the bag filter of the combustor. In the results demonstrated, the emissions of $SO_2$, NO, $N_2O$ and CO have been normalised to a flue gas having an oxygen concentration of 6%.

TABLE 2

Used equipment for gas analysis

| Gas | Range | Name/type |
|---|---|---|
| SO2(b) | 0–3000 ppm | Uras 3G, i.r. |
| SO2(a) | 0–3000 ppm | Binos, vis./i.r |
| CO | 0–1000 ppm | Uras 3G, i.r. |
| NO(a) | 0–250 ppm | Beckman 955, chemiluminescence |
| NO(b) | 0–250 ppm | Beckman 955, chemiluminescence |
| N2O | 0–500 ppm | Spectran 647, non-dispersive i.r. |
| O2(a) | 0–10% | Magnos 7G, paramagnetic |
| O2(b) | 0–10% | Magnos 7G, paramagnetic |
| O2,o (wet) | 0–10% | Westinghouse 132/218, zirconium oxide cell |

Before supplying the gas to the $N_2O$ analyser, $SO_2$ was removed in a solution of sodium carbonate, since the $N_2O$ analyser is affected negatively by high $SO_2$ contents.

The total air ratio and the air ratio of the combustion chamber were defined and calculated as follows:

The total air ratio, $\lambda_{tot}$, is defined as $$\lambda_{tot} = 1 + K_c \frac{O_2}{21 - O_2} \tag{3}$$

where $O_2$ is the oxygen content in percent of the flue gases (including moisture), measured in the convection part (i.e. 02,o in Tables 2 and 4), and $K_c$ is a correction factor and is the ratio of theoretical flue gas (including moisture) to theoretical air (i.e. moles of flue gas per moles of air under stoichiometric conditions). For the fuel used in the experiments, $K_c$=1.07.

By the air ratio of the combustion chamber is here meant the air ratio which corresponds to the conditions in the flue gas in the cyclone, i.e. before adding the final combustion air when using the inventive technique.

If flue gases are not recirculated to the fluidised bed, the air ratio of the combustion chamber can be calculated as $$\lambda_c, \text{ without recirculation} = \lambda_{tot}(1-X) \quad (4)$$

where X is the amount of the total air that is supplied to the cyclone outlet.

When recirculating flue gas, this definition of the air ratio of the combustion chamber is not suitable, since it results in an underestimation of this air ratio. A better definition in flue gas recirculation is obtained by calculating an oxygen mass balance in the two flows mixing in the cyclone outlet, i.e. supplied combustion air and the flue gases from the cyclone. This method of calculation yields a value of the oxygen concentration in the cyclone outlet before the supply of air as follows:

$$O_{2,c} = \frac{O_2(1+y) - 21x}{1-x+y} \quad (5)$$

where y is the ratio of the flue gas recirculation to the total air flow.

From this equation, the actual air ratio in the combustion chamber can be calculated as follows:

$$\lambda_c = 1 + K_c \frac{O_{2,c}}{21 - O_{2,c}} \quad (6)$$

The operating conditions used in the different test runs were as follows:

All runs were carried out at constant load, i.e. the supplied combustion air was kept constant at 3.54 kg/s, and the total air ratio was kept at 1.2 (3.5% $O_2$, wet). Cf. Table 4. The bed temperature was 850° C., the total pressure drop 6 kPa and the limestone supply constant at 165 kg/h, which corresponds to a molar ratio Ca/S of about 2.

In addition to the reference test and the tests according to the invention (reversed stage-combustion), additional tests were made, such that a total of eight different operating methods were comprised by the test series.

TEST A

Reference

About 60% air in the bottom part and about 40% secondary air (2.2 m above the air nozzles at the bottom of the combustion chamber).

TEST B

(Comparison)—All the Air in the Lower Part

In this case all the air was supplied to the bottom of the combustion chamber and no air to the cyclone outlet. This means that considerably more oxidising conditions prevail in the lower parts of the combustion chamber, compared with the reference test.

TEST C

(Comparison)—Strongly Reduced Portion of Primary Air

About 50% air in the bottom part and about 50% secondary air in a higher position in the combustion chamber (5.5 m above the air nozzles at the bottom of the combustion chamber).

TEST D

(Comparison)—Reduced Air Ratio in the Upper Part of the Combustion Chamber and Extended Primary Zone About 60% air at the bottom of the combustion chamber, about 20% secondary air (5.5 m above the bottom of the combustion chamber) and about 20% air for final combustion in the cyclone outlet. This resulted in more reducing conditions at the upper end of the combustion chamber and an extended primary zone, compared with the reference test (test A).

TEST E

(The Invention, Preferred Embodiment)—Reversed Stage-combustion (No Secondary Air Supply to the Combustion Chamber)

No secondary air in the combustion chamber, but about 20% of the total amount of air was supplied after the cyclone for final combustion. The air ratio of the combustion chamber before supplying the final combustion air was kept at about 1. This means less oxidising conditions in the upper part and more oxidising conditions in the lower part of the combustion chamber, compared with the reference test.

TEST F

(The Invention, Preferred Embodiment)—Reversed Stage-combustion

Bed ash was not removed during the test period, which resulted in a higher pressure drop in the combustion chamber.

TEST G

(The Invention, Preferred Embodiment)—Reversed Stage-combustion

Fly ash was returned to the combustion chamber from a secondary cyclone.

TEST H

(The Invention, Preferred Embodiment)—Reversed Stage-combustion

During this period 25% additional limestone was supplied and the air ratio of the combustion chamber was optimised in order to give minimum emissions.

A compilation of the tests is to be found in Table 3. The emissions of $SO_2$, NO, $N_2O$ and CO are also shown in FIGS. 3–6, while the average values are also stated in Table 4. The different results, compared with the reference test (test A), can be summarised as follows:

Test B—all the air in the lower part: Less reducing conditions in the lower part of the combustion chamber result in more efficient desulphurisation, but a considerably higher NO emission and a somewhat higher $N_2O$ emission.

Test C—strongly reduced portion of primary air: More reducing conditions in the lower part of the combustion chamber result in a dramatic reduction of the desulphurisation, while the NO emissions are reduced to a considerable extent and the $N_2O$ emissions are reduced to some extent.

Test D—reduced air ratio in the upper part: More reducing conditions in the combustor in its entirety result in similar, but more pronounced effects compared with step-by-step air supply in accordance with test C. The $N_2O$ emissions, however, decreased significantly.

Test E—reversed stage-combustion according to the invention: The $N_2O$ emissions were reduced by about three quarters, while the NO emission was halved and the $SO_2$ emission was not affected to any appreciable extent. The higher CO emission obtained in this case can be counteracted in a manner that will be described below.

The variations according to tests F, G, and H did not give any essentially different results as compared with test E, but the sulphur capture was somewhat improved by recirculation of fly ash (test G) and by supplying additional limestone (test H). An important difference between the various examples according to the invention is the small difference in respect of the air ratio of the combustion chamber (equation 6), which strongly affects all the emissions, especially the CO emission, as will be mentioned below.

Figure 2:
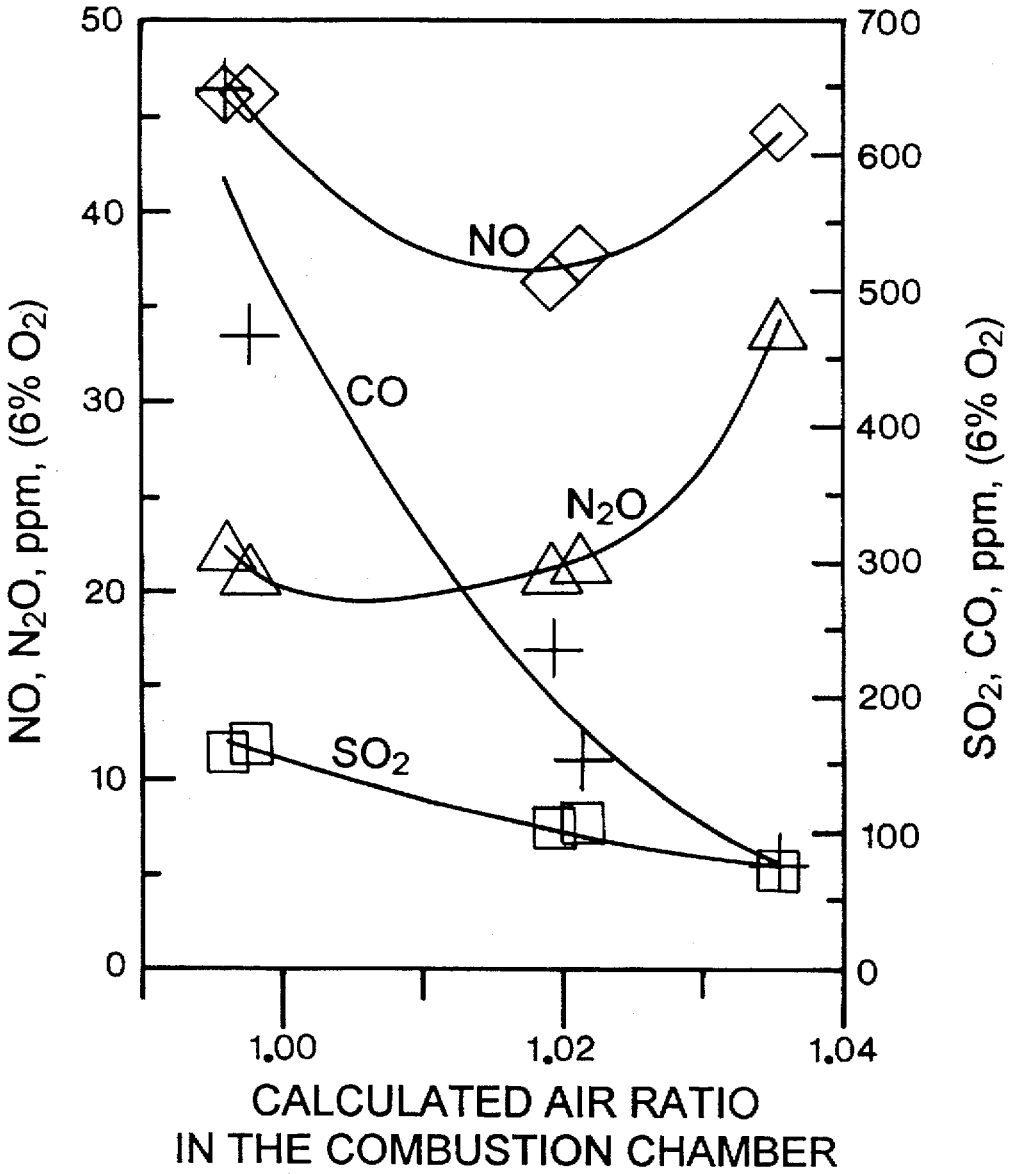
FIG. 2 is a diagram of how the emissions of different substances are affected by the air ratio of the combustion chamber (equation 6) when using the invention.

The reversed stage-combustion was further investigated by varying that portion of the total amount of air which was supplied to the cyclone outlet. The results of these further investigations are shown in FIG. 2 and Table 5. This variation was carried out with a 25% higher limestone addition, compared with tests A–G. The total air ratio was kept constant, while the portion of air that was supplied to the cyclone outlet varied. The conditions can be best characterised by the air ratio of the combustion chamber, which is obtained by equation 6, which takes the effect of the flue gas recirculation into consideration. It may be established that an optimum point in respect of emissions is $\lambda_c \approx 1.02$. Below this point, CO increases dramatically, while $SO_2$ increases slowly, $N_2O$ does not increase any longer and NO is close to its minimum (surprisingly, NO appears to pass a minimum point).

It follows from these results that the high CO emission in tests E, F and G can be explained by the air ratio of the combustion chamber, which was 1–3% lower than the optimum point in these cases (cf. Table 4).

The value of $O_{2,c}$ at the optimum point is about 0.4%, which corresponds to an air ratio $\lambda_c$ of 1.02, which makes the optimum point slightly hyperstoichiometric. However, this is within the margins of error, if any errors in measurement with respect to $O_2$ and X are taken into consideration, and $\lambda_c$ may therefore be said to be about 1 at the optimum point.

Regarding the reproducibility of the experiments it can be said that the reference run (test A) was carried out during about 5×24 h, the inventive runs (E, F, G, H and the variations shown in Table 5) were carried out during a total of 3×24 h, and the remaining runs during at least 1.5×24 h. During these running periods, representative test periods intended for calculation of the average values were selected if possible when the so-called b-analytical apparatus (Table 2) were not occupied by in-situ measurements. The periods for determining the average values were 4–6 h, but for test G it was 2.5 h, and for test H and the values in FIG. 2 and Table 5, the periods were about 1 h.

The reproducibility of the NO, $N_2O$ and CO emissions was very high. The reproducibility of the $SO_2$ emission was somewhat lower, probably as a result of variations in the sulphur content of the fuel. Also a variation of the sulphur capture of a few percent affects the $SO_2$ emission to a considerable extent, when the desulphurisation efficiency is as high as 90%.

It may be established from Table 4 that the bed temperature, the top temperature, the total air ratio (represented by $O_2$), the load (represented by the total amount of air and the total air ratio) and the total pressure drop were the same in all cases. The selected test periods were all run under stable operating conditions with typical standard deviations of <0.1% for $O_2$ and 1°–2° C. for the bed temperature and the top temperature.

The results of the tests indicate that it is possible to separate the effect of the reducing/oxidising conditions on the emissions by producing these conditions selectively in the lower and upper parts of the combustor. A considerable reduction of the $N_2O$ and NO emissions was achieved without increasing the $SO_2$ emission.

The dramatic reduction of the $N_2O$ emissions when using reversed stage-combustion according to the invention points at the important role of the reactions in the upper part of the combustion chamber. This can be explained by the high rate of reduction of $N_2O$ in the combustion chamber preventing the major part of the laughing gas ($N_2O$) formed in the lower part of the combustion chamber from passing through the combustor. This interpretation is in harmony with the moderate effect of changes of conditions in the lower part of the combustion chamber (cf. tests A, B and C). It is not known to what degree the low $N_2O$ emission in test E should be ascribed to a reduced $N_2O$ production or an increased reduction of $N_2O$.

Also for NO, the effect of less oxidising conditions in the upper part of the combustion chamber will overshadow the effect of more oxidising conditions in the lower part of the combustion chamber. This occurs in spite of the noticeable effect that the changes in the lower part of the combustion chamber have on NO, and the results show that the NO reduction in the upper part of the combustion chamber is significantly improved by less oxidising conditions.

Like for NO, the sulphur capture is very susceptible to changes in the degree of step-by-step air supply and the proportions between the air supplies at the lower end of the bed and at the cyclone outlet. Less oxidising conditions in the upper part of the combustor result in a dramatic reduction of the sulphur capture (cf. test D), if a compensation is not obtained by more oxidising conditions in the lower part of the combustor as is the case in test E according to the invention. Satisfactory desulphurisation is maintained when shifting from normal air supply (test A) to reversed stage-combustion according to the invention (tests E–H), and this indicates the importance of the bottom zone on the sulphur capturing process. Two explanations of the significance of the conditions in the lower part of the combustion chamber in connection with the sulphur capture result are 1) the high concentration of the sorbent in this zone, and 2) the fact that the major part of the sulphur is normally released from the fuel in this zone.

As shown by the tests, an undesired increase of the emission of CO has been obtained, but the increase of the CO emission was sharply reduced when changing the amount of the total air that was supplied to the cyclone outlet (cf. FIG. 2). Further improvements could be achieved by a) Preheating of the air supplied to the particle separator outlet. The temperature of the flue gas duct falls considerably when (cold) air is supplied to the cyclone outlet (see Table 4). This is assumed to contribute to the higher CO emission when using the combustion method according to the invention (tests E–H). The CO emission can probably be reduced to a considerable extent without deterioration of the other emissions if preheated air is used for the supply to the cyclone outlet.

b) Improved air distribution. In-situ measurements have shown that the oxygen concentration varies to a considerable extent across a horizontal section of the combustion chamber (also when secondary air is not supplied to the upper part of the combustion chamber). A better distribution of the air over the bottom surface of the combustion chamber would probably improve the conditions and also improve the results achieved.

c) Reduction of the amount of air that is supplied to the combustion chamber in other positions than through the bottom plate. For practical reasons, some air (about 15% of the total air quantity) was supplied from the sides of the lower part of the combustion chamber through the fuel chute, the particle cooler and the air separators. If this amount is reduced, this would probably further improve the results achieved.

The combustion loss in the form of unburnt material in the fly ash increased by about 25%, compared with the reference test (test A), which resulted in a reduction of the combustion efficiency by about 2%. This reduction would probably be smaller in a larger (higher) combustor having a more efficient cyclone. The combustion loss can also be reduced by recirculation of fly ash from a secondary cyclone (cold). An air ratio for the combustion chamber corresponding to the optimum point is expected to reduce the combustion loss, but this test was not run long enough to make it possible to achieve a verification of the combustion efficiency.

It is not known whether the lower oxygen concentration in the upper part of the combustion chamber could have any effect on the radiation combustion surfaces (tube panels) of the combustor.

The increased air flow to the bottom zone results in a higher power consumption, but this is compensated for by the fact that all noxious emissions could be reduced when using the invention.

TABLE 3

Compilation of Tests

The percentage of the total amount of air supplied through the bottom plate, at a height of 2.2 m and a height of 5.5 m as well as to the cyclone outlet (the sum is not 100% since a certain amount of air was supplied to the lower part via the particle cooler, the air separators and the fuel feed chute).

| Test | Bottom | 2.2 m | 5.5 m | Cyclone | Comments |
|---|---|---|---|---|---|
| A | 49 | 35 | — | — | reference |
| B | 85 | — | — | — | no secondary air |
| C | 36 | — | 47 | — | more reducing in the lower part |
| D | 45 | — | 19 | 19 | more reducing all over |
| E | 65 | — | — | 21 | reversed stage-combustion |
| F | 67 | — | — | 20 | reversed, high bed |
| G | 66 | — | — | 19 | reversed, fly ash |
| H | 66 | — | — | 20 | reversed, additional limestone |

TABLE 4

AVERAGE VALUES

The columns show the following:

| | | | |
|---|---|---|---|
| Tbd | temperature in bed, °C. | CO | ppm CO normalised to 6% 02 |
| Ttop | temperature in the upper end of the combustion chamber, °C. | ΔPtt | total pressure drop in combustion chamber, kPa |
| | | Airt | total air flow, kg/s |
| O2,o | % $O_2$ (wet) | Prim | primary air flow, kg/s |
| O2a | % $O_2$ (dry) analyser a | Sec | total secondary air flow, including final combustion air, kg/s |
| O2b | % $O_2$ (dry) analyser b | | |
| SOa | ppm $SO_2$, normalised to 6% $O_2$ | Rg4 | secondary air flow at 5.5 m, kg/s |
| SOb | ppm $SO_2$, normalised to 6% $O_2$ | Rg5 | final combustion air flow to cyclone outlet, kg/s |
| NOa | ppm NO, normalised to 6% $O_2$ | FGr | recirculated flue gas, kg/s |
| NOb | ppm NO, normalised to 6% $O_2$ | Tex | temperature in flue gas exit duct 5, °C. |
| N2O | ppm $N_2O$, normalised to 6% $O_2$ | λboil | air ratio in the combustion chamber (equation 6) |

| Test | Tbd | Ttop | O2,o | O2a | O2b | SOa | SOb | NOa | NOb | N2O | CO | ΔPtt | Airt | Pri | Sec | Rg4 | Rg5 | FGr | Tex | λboil |
|---|---|---|---|---|---|---|---|---|---|---|---|---|---|---|---|---|---|---|---|---|
| A | 851 | 859 | 3.47 | 3.99 | 3.83 | 123 | 133 | 80 | 85 | 97 | 42 | 6.1 | 3.54 | 1.74 | 1.25 | 0.00 | 0.00 | 0.98 | 832 | 1.213 |
| B | 851 | 859 | 3.46 | 3.97 | 3.85 | 68 | 68 | 139 | 138 | 125 | 30 | 6.0 | 3.54 | 3.01 | 0.00 | 0.00 | 0.00 | 0.21 | 822 | 1.212 |
| C | 852 | 868 | 3.46 | 3.89 | 3.77 | 317 | 301 | 71 | 71 | 94 | 58 | 6.0 | 3.54 | 1.27 | 1.67 | 1.65 | 0.00 | 1.00 | 853 | 1.212 |
| D | 852 | 860 | 3.46 | 3.77 | 3.64 | 385 | 370 | 45 | 46 | 18 | 142 | 6.9 | 3.54 | 1.61 | 1.36 | 0.68 | 0.69 | 0.87 | 779 | 1.010 |
| E | 850 | 855 | 3.48 | 4.27 | * | 124 | * | 32 | * | 30 | 329 | 6.0 | 3.54 | 2.31 | 0.82 | 0.00 | 0.74 | 1.04 | 743 | 1.007 |
| F | 851 | 855 | 3.47 | 4.13 | 3.78 | 153 | 129 | 35 | 40 | 23 | 410 | 8.6 | 3.54 | 2.37 | 0.76 | 0.00 | 0.70 | 0.73 | 741 | 1.003 |
| G | 851 | 857 | 3.48 | 4.04 | * | 74 | * | 41 | * | 25 | 440 | 6.0 | 3.55 | 2.36 | 0.76 | 0.00 | 0.69 | 0.42 | 748 | 0.990 |
| H | 850 | 855 | 3.44 | 3.92 | 3.66 | 99 | 103 | 38 | 36 | 22 | 153 | 6.0 | 3.55 | 2.35 | 0.78 | 0.00 | 0.71 | 1.25 | 759 | 1.020 |

*not analysed, since the b analyser was used for in-situ measurement

TABLE 5

Variation of the air factor of the combustion chamber in reversed air supply (cf. Table 4)

| Tbd | Ttop | O2,o | O2a | SOa | SOb | NOa | NOb | N20 | CO | ΔPtt | Airt | Rg5 | FGr | Tex | λboil |
|---|---|---|---|---|---|---|---|---|---|---|---|---|---|---|---|
| 849 | 853 | 3.49 | 4.04 | 70 | 66 | 44 | 43 | 34 | 76 | 6.0 | 3.54 | 0.659 | 1.21 | 762 | 1.035 |
| 851 | 858 | 3.38 | 3.92 | 106 | 103 | 38 | 36 | 22 | 151 | 5.9 | 3.55 | 0.689 | 1.23 | 764 | 1.021 |
| 849 | 853 | 3.51 | 4.05 | 103 | 101 | 36 | 35 | 21 | 238 | 6.0 | 3.55 | 0.731 | 1.26 | 754 | 1.019 |
| 851 | 854 | 3.42 | 3.95 | 165 | 174 | 47 | 47 | 21 | 470 | 5.9 | 3.54 | 0.787 | 1.24 | 738 | 0.998 |
| 848 | 851 | 3.56 | 4.07 | 159 | 171 | 46 | 50 | 22 | 651 | 6.1 | 3.55 | 0.823 | 1.22 | 726 | 0.996 |

We claim:

1. A two-stage method for combustion of solid fuels with a circulating fluidized bed disposed in a combustor, the method comprising the steps of:

providing a combustion chamber having a lower portion and an upper portion;

providing oxygen-containing fluidizing gas;

establishing a bed of solid fuel particles disposed in the combustion chamber;

introducing the oxygen-containing fluidizing gas into the bed;

fluidizing the bed with the oxygen-containing fluidizing gas;

promoting combustion of the fuel particles;

producing flue gases;

entraining a portion of the fuel particles by the flue gases;

separating the entrained portion of the fuel particles from the flue gases;

recirculating a portion of the separated fuel particles to the combustion chamber;

subjecting the flue gases separated from the fuel particles to after-burning by admixing oxygen-containing gas therewith;

maintaining substantially oxidizing conditions in a gas phase at the lower portion of the combustion chamber; and maintaining approximately stoichiometric conditions in a gas phase at the upper portion of the combustion chamber.

2. The method according to claim 1 wherein the method further comprises the steps of providing low and medium volatile fuels for combustion and a dry and ashless substance, the low and medium volatile fuels having a volatile content of between 1% and 63% based on the dry and ashless substance and maintaining an air ratio of between 0.9 and 1.1 in the lower portion of the combustion chamber.

3. The method according to claim 2 wherein the step of maintaining an air ratio includes the step of maintaining an air ratio of between about 0.95 and about 1.05 in the lower portion of the combustion chamber.

4. The method according to claim 3 wherein the step of maintaining an air ratio includes the step of maintaining an air ratio of between about 0.98 and about 1.03 in the lower portion of the combustion chamber.

5. The method according to claim 4 wherein the step of maintaining an air ratio includes the step of maintaining an air ratio of about 1 in the lower portion of the combustion chamber.

6. The method according to claim 5 wherein the step of maintaining an air ratio includes the step of maintaining an air ratio of at least 1 in the lower portion of the combustion chamber.

7. The method according to claim 1 wherein the method further comprises the steps of providing high volatile fuels for combustion and a dry and ashless substance, the high volatile fuels having a volatile content of between 63% and 92% based on the dry and ashless substance and maintaining an air ratio of between 0.8 and 1.1 in the lower portion of the combustion chamber.

8. The method according to claim 7 wherein the step of maintaining an air ratio includes the step of maintaining an air ratio of between about 0.95 and about 1.05 in the lower portion of the combustion chamber.

9. The method according to claim 8 wherein the step of maintaining an air ratio includes the step of maintaining an air ratio of between about 0.98 and about 1.03 in the lower portion of the combustion chamber.

10. The method according to claim 9 wherein the step of maintaining an air ratio includes the step of maintaining an air ratio of about 1 in the lower portion of the combustion chamber.

11. The method according to claim 10 wherein the step of maintaining an air ratio includes the step of maintaining an air ratio of at least 1 in the lower portion of the combustion chamber.

12. The method according to claim 1 wherein the method further comprises the steps of:

providing secondary air;

supplying a total amount of secondary air to the lower portion of the combustion chamber;

separating a portion of the secondary air supplied to the lower portion of the combustion chamber, the portion accounting for up to 15% of the total amount;

supplying the portion of the separated secondary air to a section of the combustion chamber that is disposed above the lower portion of the combustion chamber;

burning the fuel particles; and maintaining approximately oxidizing conditions in the gas phase at the lower portion of the combustion chamber.

13. The method according to claim 12 wherein the portion of secondary air accounts for up to 10% of the total amount of secondary air.

14. The method according to claim 12 wherein the portion of secondary air accounts for up to 5% of the total amount of secondary air.

15. A two-stage method for combustion of solid fuels with a circulating fluidized bed disposed in a combustor, the method comprising the steps of:

providing a combustion chamber having a lower portion and an upper portion;

providing oxygen-containing fluidizing gas and secondary air;

providing a dry and ashless substance;

providing volatile fuels having a volatile content of between 1% and 92% based on the dry and ashless substance;

establishing a bed of solid fuel particles disposed in the combustion chamber;

introducing the oxygen-containing fluidizing gas into the bed;

fluidizing the bed with the oxygen-containing fluidizing gas;

promoting combustion of the fuel particles;

producing flue gases;

entraining a portion of the fuel particles by the flue gases;

separating the entrained portion of the fuel particles from the flue gases;

recirculating a portion of the separated fuel particles to the combustion chamber;

subjecting the flue gases separated from the fuel particles to after-burning by admixing oxygen-containing gas therewith;

supplying a total amount of secondary air to the lower portion of the combustion chamber;

separating a portion of the secondary air supplied to the lower portion of the combustion chamber, the portion accounting for up to 5% of the total amount;

supplying the portion of the separated secondary air to a section of the combustion chamber that is disposed above the lower portion of the combustion chamber;

burning the fuel particles;

maintaining substantially oxidizing conditions in a gas phase at the lower portion of the combustion chamber;

maintaining approximately stoichiometric conditions in a gas phase at the upper portion of the combustion chamber; and maintaining an air ratio of about 1 in the lower portion of the combustion chamber.

* * * * *

UNITED STATES PATENT AND TRADEMARK OFFICE

CERTIFICATE OF CORRECTION

PATENT NO. : 5,715,764

DATED : February 10, 1998

INVENTOR(S) : Lyngfelt, et al.

It is certified that error appears in the above-indentified patent and that said Letters Patent is hereby corrected as shown below:

TITLE PAGE

Assignee: Delete "Kvaener EnviroPower AB" and replace with --Kvaerner EnviroPower AB--.

Signed and Sealed this

Seventh Day of July, 1998

Bruce Lehman

*Attest:*

BRUCE LEHMAN

*Attesting Officer*

*Commissioner of Patents and Trademarks*